US011059311B2

(12) United States Patent
Asai

(10) Patent No.: US 11,059,311 B2
(45) Date of Patent: Jul. 13, 2021

(54) PRINTER

(71) Applicant: TOSHIBA TEC KABUSHIKI KAISHA, Tokyo (JP)

(72) Inventor: Yoshinori Asai, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/453,331

(22) Filed: Jun. 26, 2019

(65) Prior Publication Data

US 2019/0315140 A1 Oct. 17, 2019

Related U.S. Application Data

(62) Division of application No. 15/935,202, filed on Mar. 26, 2018, now Pat. No. 10,576,767.

(30) Foreign Application Priority Data

Jul. 4, 2017 (JP) ..... JP2017-131351

(51) Int. Cl.
*B41J 35/08* (2006.01)
*B41J 2/325* (2006.01)
(Continued)

(52) U.S. Cl.
CPC ..... *B41J 35/08* (2013.01); *B41J 2/325* (2013.01); *B41J 3/4075* (2013.01); *B41J 35/04* (2013.01);
(Continued)

(58) Field of Classification Search
CPC ..... B41J 35/08; B41J 2/325; B41J 3/4075; B65H 23/038; B65H 2404/1521
See application file for complete search history.

(56) References Cited

U.S. PATENT DOCUMENTS 4,768,890 A * 9/1988 Makino ..... B41J 35/08 400/234
4,815,874 A 3/1989 Richardson et al.
2007/0231041 A1* 10/2007 Ueda ..... B41J 17/30 400/234

FOREIGN PATENT DOCUMENTS

DE 2407842 A1 8/1975
JP S57-57688 A 4/1982
(Continued)

OTHER PUBLICATIONS

Extended European Search Report dated Nov. 22, 2018, mailed in counterpart European Application No. 18180059.0, 9 pages.

*Primary Examiner* — Matthew Luu
*Assistant Examiner* — Kendrick X Liu
(74) *Attorney, Agent, or Firm* — Kim & Stewart LLP

(57) ABSTRACT

A printer includes a printing unit having a printing head and a platen positioned opposite the printing head, the printing head being configured to print on a print medium that is fed between the printing head and the platen, a ribbon holding shaft configured to hold an ink ribbon that is wound thereon, a ribbon winding shaft configured to wind and collect the ink ribbon supplied from the ribbon holding shaft, and first and second guide shafts provided along a feeding route of the ink ribbon between the ribbon holding shaft and the ribbon winding shaft to apply tension to the ink ribbon. At least one of the first and second guide shafts has a tilt adjuster that applies a twist to the ink ribbon in a width direction of the ink ribbon through said at least one of the first and second guide shafts.

12 Claims, 4 Drawing Sheets

(51) Int. Cl.
*B41J 3/407* (2006.01)
*B65H 23/038* (2006.01)
*B41J 35/04* (2006.01)

(52) U.S. Cl.
CPC . *B65H 23/038* (2013.01); *B65H 2404/15212* (2013.01)

(56) References Cited

FOREIGN PATENT DOCUMENTS

| | | | |
|---|---|---|---|
| JP | H04-25486 | A | 1/1992 |
| JP | H06-336041 | A | 12/1994 |
| JP | 2001-130118 | A | 5/2001 |

* cited by examiner

PRINTER

CROSS-REFERENCE TO RELATED APPLICATIONS

This application is a division of U.S. patent application Ser. No. 15/935,202, filed on Mar. 26, 2018, which is based upon and claims the benefit of priority from Japanese Patent Application No. 2017-131351, filed on Jul. 4, 2017, the entire contents of each of which are incorporated herein by reference.

FIELD

Embodiments described herein relate generally to a printer.

BACKGROUND

Among known printers such as label printers, thermal printers are widely used. The thermal printer transfers ink that is coated on an ink ribbon by heating and melting the ink with a thermal head. In such a printer, the ink ribbon is stretched between a ribbon holding shaft and a ribbon winding shaft, and an end of the winding shaft is rotated by a motor to feed the ribbon. This winding shaft is installed as a cantilever in which only one end of the winding shaft is driven by a driving motor. In this printer, twisting of the ink ribbon along a feeding direction may occur. There may be multiple factors for the twisting, and a combination of the multiple factors causes the ink ribbon to twist.

For example, when the motor is provided at one end of the ribbon winding shaft as described above, the winding shaft may become slightly deformed and may have a torque difference in accordance with the distance from the motor, because the winding shaft is elongated in the width direction of the ribbon. As a result, tension of the ribbon differs between a part of the ribbon in a side near the motor and a part of the ribbon in a side away from the motor, which can cause the ribbon to twist. Moreover, the ink ribbon may twist because of a difference in friction in the width direction of the ribbon when the ribbon is at a position in which the thermal head faces a platen, and a slight tilt relative to the feeding direction of the ribbon in a linear facing area of the thermal head and the platen. Furthermore, due to the above-described cantilever arrangement, a slight tilt of a mounting angle of the ribbon winding shaft or the ribbon holding shaft facilitates twisting of the ribbon. The ink ribbon that is twisted at a transferring position at which the thermal head contacts the ribbon, causes poor print quality.

The related art discloses a mechanism for adjusting tension of a ribbon between a winding shaft and a feeding shaft, but this mechanism does not prevent an ink ribbon from twisting.

DETAILED DESCRIPTION

Embodiments provide a printer configured to reduce twisting of an ink ribbon.

In general, according to one embodiment, a printer includes a printing unit having a printing head and a platen positioned opposite the printing head, the printing head being configured to print on a print medium that is fed between the printing head and the platen, a ribbon holding shaft configured to hold an ink ribbon that is wound thereon, a ribbon winding shaft configured to wind and collect the ink ribbon supplied from the ribbon holding shaft, and first and second guide shafts provided along a feeding route of the ink ribbon between the ribbon holding shaft and the ribbon winding shaft to apply tension to the ink ribbon. At least one of the first and second guide shafts has a tilt adjuster that applies a twist to the ink ribbon in a width direction of the ink ribbon through said at least one of the first and second guide shafts.

Hereinafter, an example of a printer relating to embodiments of the present disclosure will be described in detail with reference to the accompanying drawings. The embodiments described below are not intended to limit the scope of the present disclosure.

Figure 1:
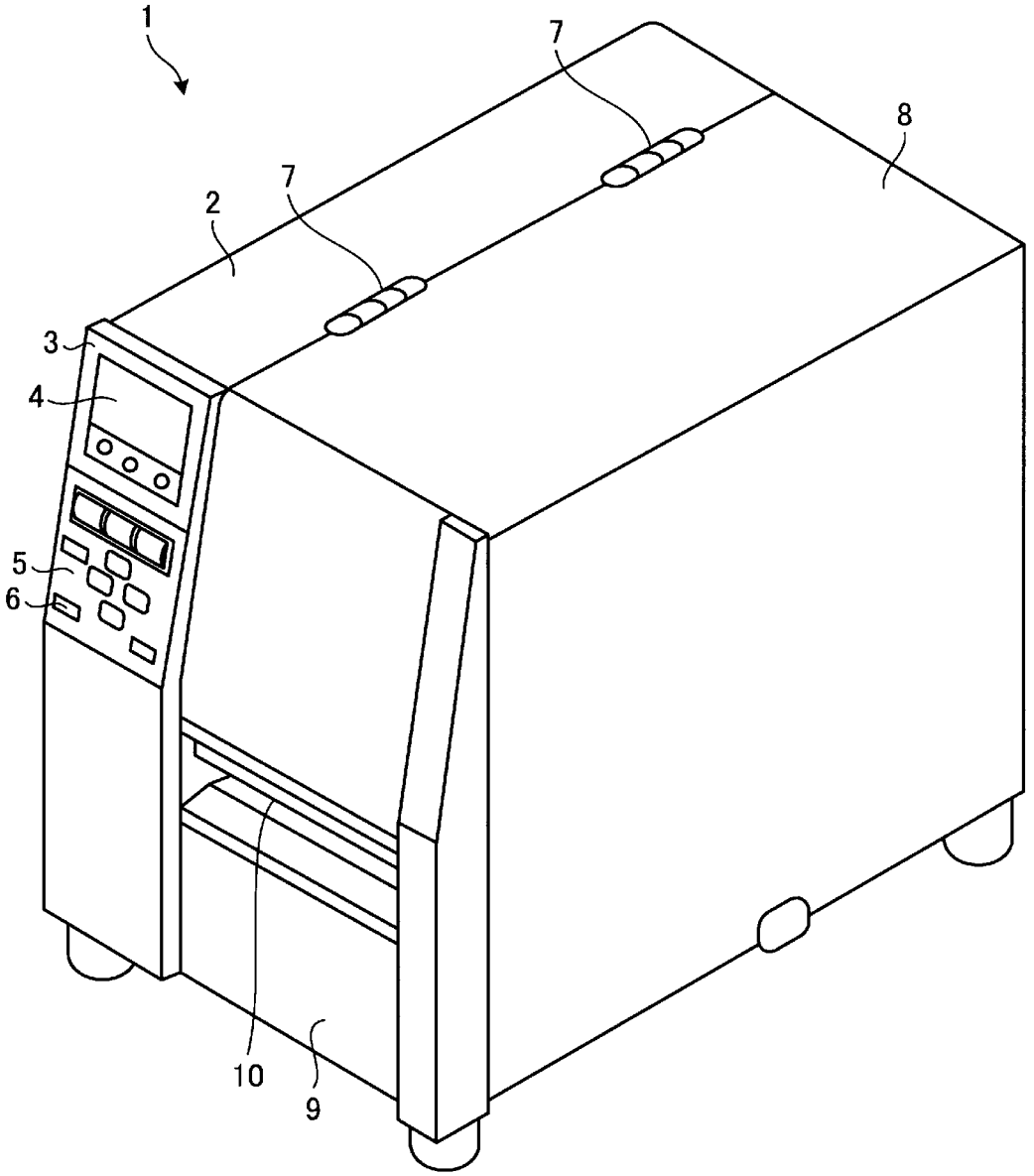
FIG. 1 is an external perspective view of a printer of an embodiment.

FIG. 1 is an external perspective view of a printer 1. As shown in FIG. 1, the printer 1 includes a case 2 on a left side and a case 8 that is connected to a right side of the case 2 by hinges 7. The case 2 has a front panel 3 including a display 4 and a controller 5. The display 4 includes a liquid crystal display with a backlight, but may be a display device of other type. The controller 5 includes multiple operation buttons 6.

The case 8 on the right side is configured so that the inside of a housing (that is, the cases 2 and 8) can be exposed by rotating the case 8 about the hinges 7. As described later with reference to FIG. 2, the printer 1 has a label paper 20 that is wound in a rolled state, an ink ribbon 30 that is stretched between two shafts, and a printing unit 23 for printing the label paper 20, in the housing. In order to facilitate maintenance such as replacement of the ink ribbon 30 and the label paper 20, the case 8 can be opened by rotating the case 8 about the hinges 7. The case 8 includes a front panel 9 having a label issuing port 10. The printer 1 issues a printed label from the label issuing port 10.

Figure 2:
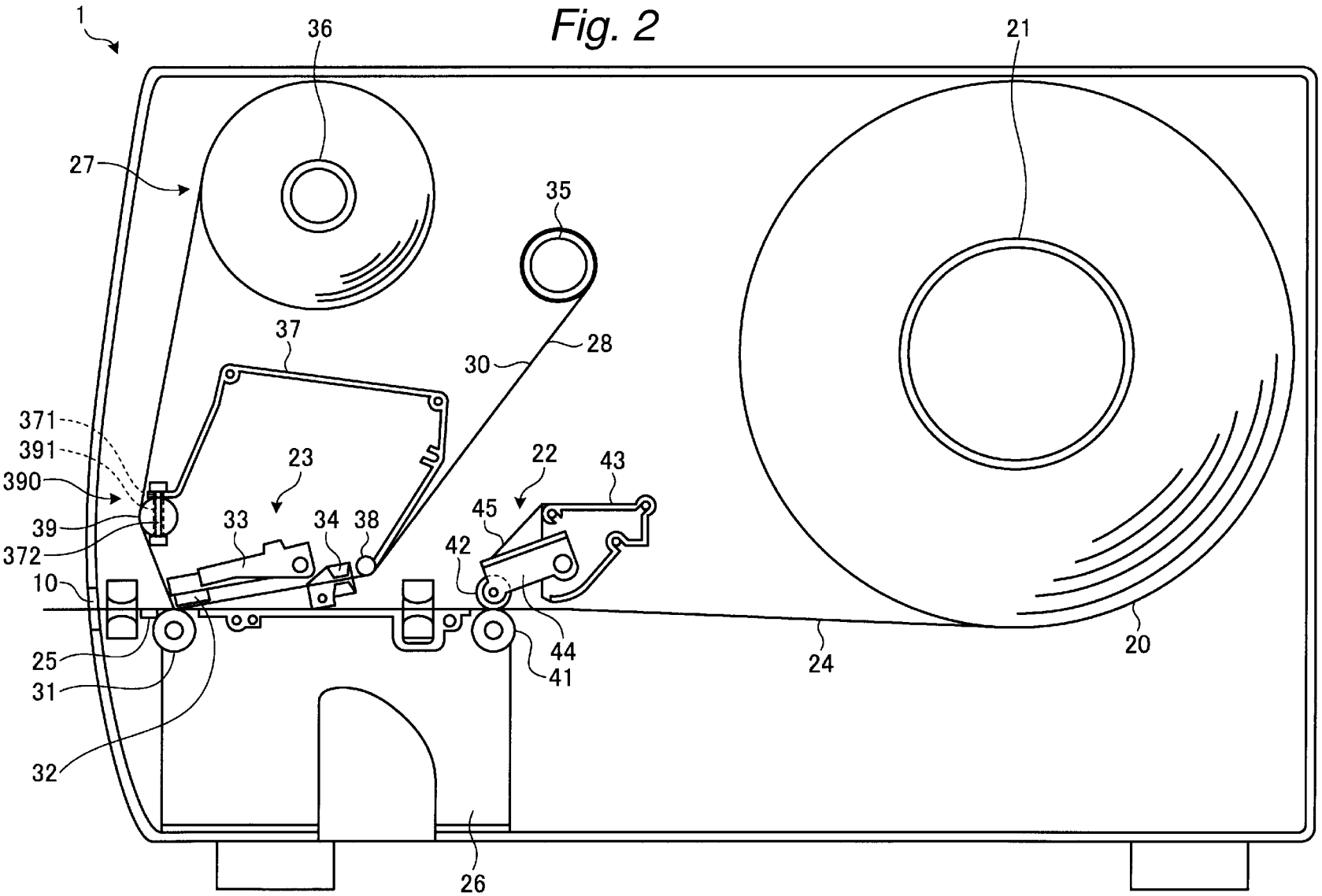
FIG. 2 is a schematic sectional view of a structure inside a printer.

FIG. 2 is a schematic sectional view of the structure inside the printer 1. As shown in FIG. 2, the printer 1 includes a paper holder 21, a paper feeder 22, the printing unit 23, a frame 26, and an ink ribbon feeder 27, in the housing.

The paper holder 21 is a shaft for holding the label paper 20 that is wound in a rolled state. An example of the label paper 20 is an adhesive surface of a label is attached to a base paper. The label paper 20 is fed out from the paper holder 21 and is printed by the printing unit 23 after passing through the paper feeder 22, and the printed label paper 20 is discharged from the label issuing port 10.

The paper feeder 22 includes a paper feeding roller 41, a pinch roller 42, a frame 43, a support 44, and a plate spring 45. The pinch roller 42 is rotatably supported by the support 44. The paper feeding roller 41 and the pinch roller 42 contact each other via the label paper 20 that is fed through a feeding route 24. The paper feeding roller 41 is rotatably mounted to the frame 26 and is rotatively driven by a motor (not shown).

The support 44 is rotatably mounted to the frame 43. An end of the plate spring 45 is attached to the frame 43, and the other end of the plate spring 45 contacts the pinch roller 42. The pinch roller 42 is biased by the plate spring 45 and is thereby brought into contact with the paper feeding roller 41 via the label paper 20.

The structure of the paper feeder 22 is not limited to the structure exemplified in FIG. 2. Additional roller (s) may be provided upstream of the pinch roller 42 in the paper feeding direction on the same side as the pinch roller 42. In this case, a rubber belt may be applied between the pinch roller 42 and the additional roller(s), and the rubber belt may be rotated to feed the label paper 20 to the printing unit 23 side.

The feeding route 24 of the label paper 20 starts from a point at which the label paper 20 is fed out from the paper holder 21. The feeding route 24 extends past a position at which the pinch roller 42 and the paper feeding roller 41 face each other. The feeding route 24 further extends past a position at which a printing head 32 and a platen 31 face each other and terminates at the label issuing port 10.

A label separating plate 25 is provided downstream of the printing unit 23 in the feeding direction. In order to separate the label and the mount, the label separating plate 25 bends the label paper 20 during feeding. The mount is wound by a winding shaft (not shown), whereas the label separated from the mount is issued from the label issuing port 10.

The printing unit 23 includes the platen 31 and the printing head 32 that is a line thermal printer head. The platen 31 is rotatably mounted to the frame 26 and is driven by a motor (not shown).

The printing head 32 is secured by a head holder 33 that is rotatably mounted to a frame (not shown). The distance between the printing head 32 and the platen 31 is adjusted in accordance with the rotating movement of the head holder 33. The printer 1 has a head-up mechanism (not shown) to move the printing head upwardly 32. Also the printer 1 has a head pressurizing mechanism (not shown) to pressurize the printing head 32 toward the platen 31. When the head-up mechanism is activated, the printing head 32 starts to separate from the platen 31. When the head pressurizing mechanism is activated, the printing head 32 starts approaching the platen 31. Thus, the printing head 32 is positioned for printing the label paper 20.

The ink ribbon feeder 27 includes a ribbon holding shaft 35, a ribbon winding shaft 36, a ribbon end sensor 34, and a guide frame 37. The ribbon holding shaft 35 holds the unused ink ribbon 30 that is wound in a rolled state. The ribbon winding shaft 36 winds and collects the used ink ribbon 30. The ribbon end sensor 34 detects an end of the ink ribbon 30.

The guide frame 37 includes a first guide shaft 38 at an end thereof on the ribbon holding shaft 35 side, and the first guide shaft 38 guides the ink ribbon 30 that is fed out from the ribbon holding shaft 35. The guide frame 37 also has a second guide shaft 39 at an end thereof on the ribbon winding shaft 36 side, and the guide shaft 39 guides the ink ribbon 30 to the ribbon winding shaft 36. The first and second guide shafts 38 and 39 are provided along a feeding route 28 of the ink ribbon 30 between the ribbon holding shaft 35 and the ribbon winding shaft 36. The ink ribbon 30 is stretched between the first and second guide shafts 38 and 39.

The unused ink ribbon 30 contacts the first guide shaft 38 and then passes through the ribbon end sensor 34 to reach the position at which the printing head 32 and the platen 31 face each other (that is, a transferring position or a printing position). Thereafter, printing is performed by the printing head 32. The used ink ribbon 30 contacts the second guide shaft 39 and is then wound and collected by the ribbon winding shaft 36.

That is, the feeding route 28 of the ink ribbon 30 starts from a point at which the ink ribbon 30 is fed out from the ribbon holding shaft 35 and passes through a position at which the ink ribbon 30 contacts the first guide shaft 38 of the guide frame 37. Then, the feeding route 28 passes through the detection target area of the ribbon end sensor 34 and further passes through the position at which the printing head 32 and the platen 31 face each other. Furthermore, the feeding route 28 passes through a position at which the ink ribbon 30 contacts the second guide shaft 39 of the guide frame 37 and ends at a point at which the ink ribbon 30 is wound by the ribbon winding shaft 36.

Figure 3:
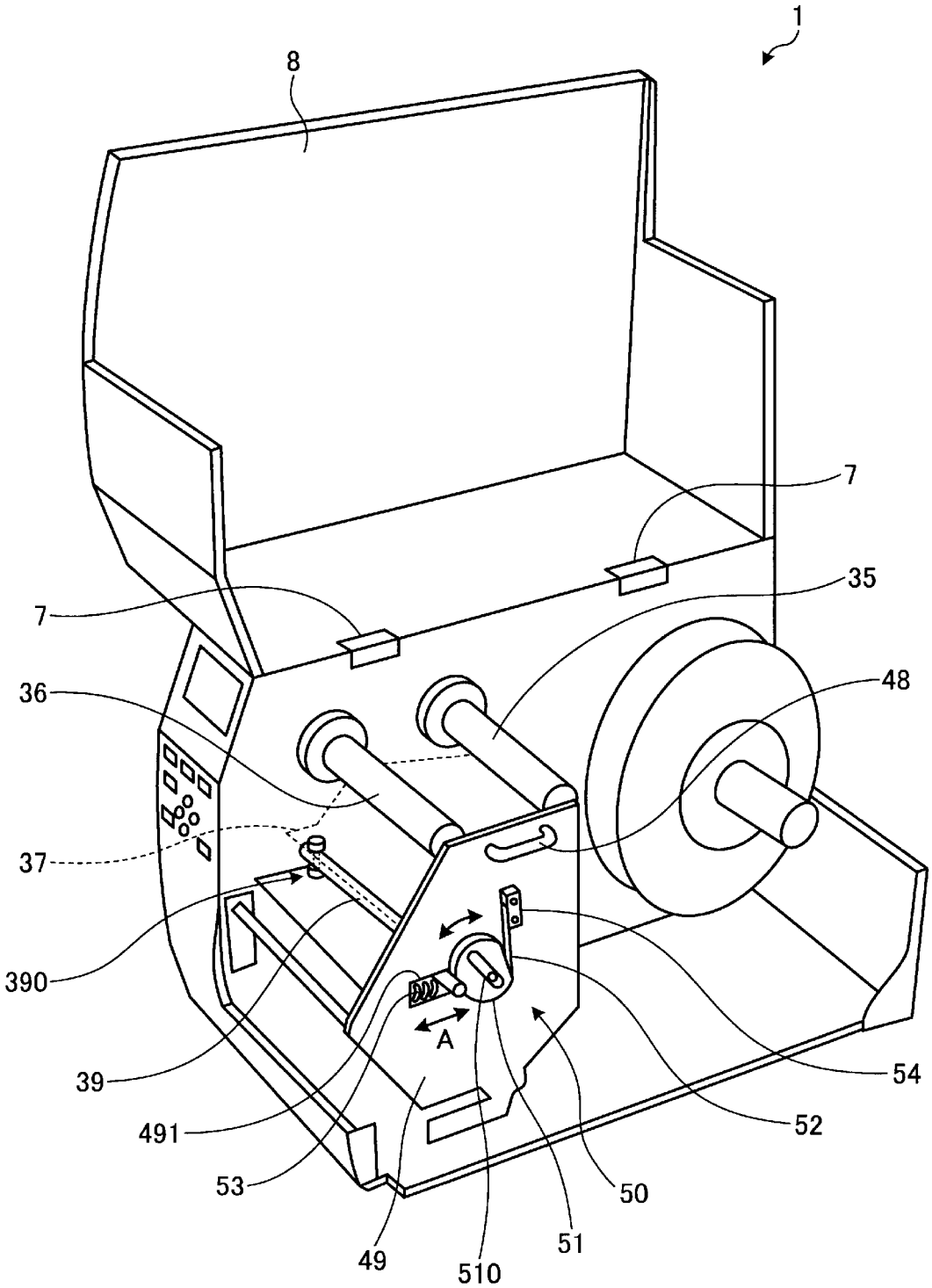
FIG. 3 is a perspective view of a tilt adjuster.

In this embodiment, the second guide shaft 39 is provided with a tilt adjuster 50 (refer to FIG. 3). The tilt adjuster 50 adjusts tilt of the ink ribbon 30 in the width direction at the second guide shaft 39.

Figure 4:
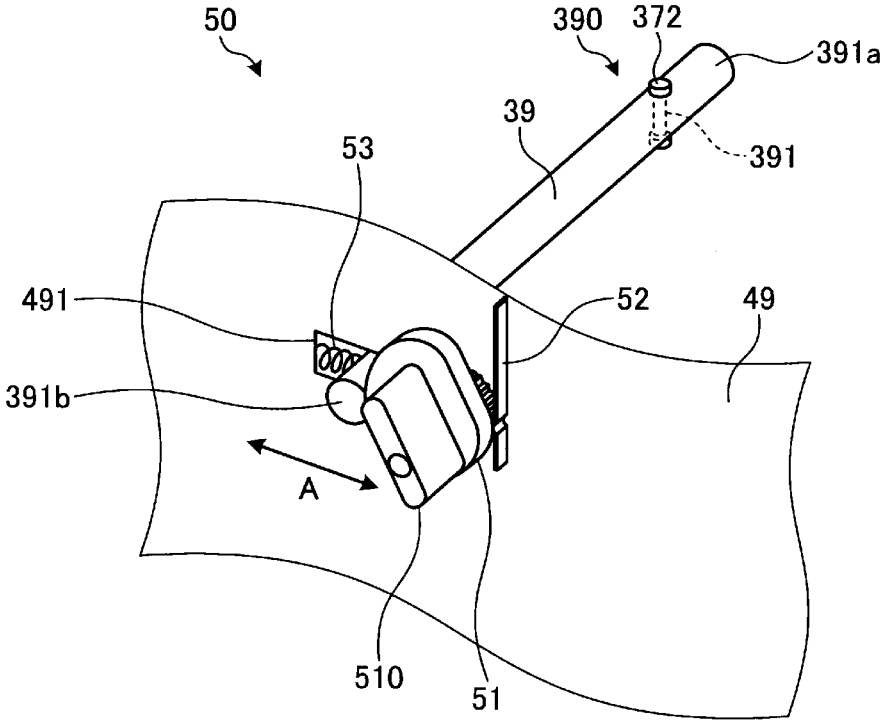
FIG. 4 is a partial view of the tilt adjuster.

FIG. 3 is a perspective view of the tilt adjuster 50. FIG. 3 schematically shows the printer 1 of which the inside is opened by turning the case 8 around the hinges 7. FIG. 4 is a partial view of the tilt adjuster 50. The same elements shown in FIGS. 3 and 4 as those described with reference to FIG. 1 or 2 are denoted by the same symbols, and descriptions thereof may not be repeated.

As shown in FIG. 3, the printer 1 includes the guide frame 37 (shown by the dotted line in the drawing) under the ribbon holding shaft 35 and the ribbon winding shaft 36. The guide frame 37 is supported by the housing of the main body of the printer 1. The guide frame 37 includes a supporting mechanism 390 that supports an end of the second guide shaft 39. As shown in FIG. 3, the tilt adjuster 50 includes the supporting mechanism 390, a cam 51, a cam spring 52, and a spring 53.

An example of the structure of the supporting mechanism 390 of the second guide shaft 39 will be described. In one example, a through hole 371 (refer to FIG. 2) is provided at the guide frame 37 in the vicinity of the second guide shaft 39 on a side in which the motor of the ribbon winding shaft 36 is provided. The position of the motor of the ribbon winding shaft 36 is provided near the ribbon winding shaft 36. Also, a through hole 391 (refer to FIGS. 2 and 4) is provided in proximity to the end of the second guide shaft 39. As shown in FIG. 2, a supporting pin 372 is inserted into the through holes 371 and 391 and is fastened by screwing the both ends. The second guide shaft 39 thus supported is rotatable around the supporting pin 372 relative to the guide frame 37.

The structure of the supporting mechanism 390 for supporting the end of the second guide shaft 39 is not limited to the example described above. Any structure of the supporting mechanism 390 can be used on condition that the opposite sides thereof are displaceable laterally.

As shown in FIG. 3, the printer 1 includes a frame 49 that can be removed with respect to the housing of the main body by pulling a handle 48 toward the front side. The frame 49 is provided with an opening 491 into which the end **391*b* (refer to FIG. 4) of the second guide shaft 39 is inserted. The height of the opening 491 is determined so that the second guide shaft 39 stays firm without shaking. As shown in FIGS. 3 and 4, the second guide shaft 39 is biased by the spring 53 towards the cam 51 and the second guide shaft 39 contacts the cam 51**.

The cam spring 52 is attached to the frame 49 with a fixing member 54 (refer to FIG. 3) or other means. The cam spring 52 may be a plate, and biases the cam 51 from the opposite side of the spring 53. The second guide shaft 39 and the cam 51 are brought into contact with each other by biasing from both sides by the spring 53 and the cam spring 52. The biasing from the both sides enables fine adjustments of rotation of the cam 51 and displacement in lateral direction of the second guide shaft 39 as well as retaining the displaced position in the lateral direction.

When an operator turns a knob 510 of the cam 51, the turn of the cam 51 is converted into movement in the lateral direction of the second guide shaft 39, thereby displacing the end 391*b* (refer to FIG. 4) of the guide shaft 39 in a horizontal direction (lateral direction) indicated by an arrow A (refer to FIG. 3). The direction indicated by the arrow A is the same direction as the feeding direction of the ink ribbon 30.

While an end 391*a* is fixed by the supporting mechanism 390, the end 391*b* is free in the direction indicated by the arrow A by adjusting the knob 510. This structure adjusts the position of the ends 391*a* and 391*b* in the feeding direction of the ribbon. Thus, the tilt of the second guide shaft 39 relative to the width direction of the ribbon is adjusted. In other words, the structure adjusts the deformation of the second guide shaft 39 relative to the feeding direction of the ribbon.

Accordingly, the tilt in the width direction of the ink ribbon 30 is also adjusted. Consequently, deviation in the width direction of the ink ribbon 30 is decreased, thereby preventing twisting of the ink ribbon 30.

Next, details of the structure of the cam mechanism will be exemplified. The cam 51 in this embodiment has a ratchet mechanism.

Figure 5:
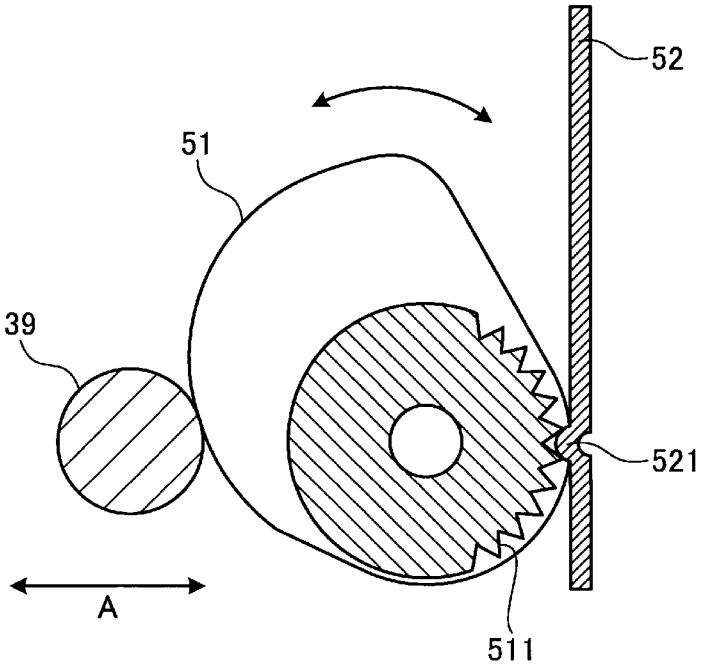
FIG. 5 is a schematic sectional view of a cam structure.

FIG. 5 is a schematic sectional view of an exemplary structure of the cam 51. The cam 51 includes a ratchet 511. Teeth of the ratchet 511 engage with a protrusion 521 of the cam spring 52, and the rotation angle of the cam 51 is changed stepwise. The stepwise change of the rotation angle makes it possible for the second guide shaft 39 to change the position in the direction indicated by the arrow A in a precise manner.

As described above, the printer 1 of this embodiment includes the tilt adjuster 50 at the second guide shaft 39 and is configured so that the tilt of the second guide shaft 39 in the width direction of the ink ribbon 30 will be changed. This structure enables adjustment of the tension of the ink ribbon 30 between the first guide shafts 38 and 39, and thus this embodiment provides a printer configured to reduce twisting of the ink ribbon 30.

In this embodiment, the tilt adjuster 50 is provided to the second guide shaft 39 in the vicinity of the ribbon winding shaft 36. Since the ink ribbon 30 is pulled to the ribbon winding shaft 36 by driving a motor, the tension of the ink ribbon 30 is greater in the vicinity the ribbon winding shaft 36 than the ribbon holding shaft 35. Accordingly, providing the tilt adjuster 50 to the second guide shaft 39 in the vicinity of the ribbon winding shaft 36 allows more efficient adjustment of the tilt of the ink ribbon 30.

In this embodiment, the supporting mechanism 390 is provided at the end 391*a*, and the cam 51 is provided at the end 391*b*. Thus, it is possible to facilitate operation because the knob 510 is located in front of the operator when the case 8 is open. However, the invention is not limited to this embodiment. For example, the supporting mechanism 390 may be provided at the end 391*b*, and the cam 51 and the other components may be provided at the end 391*a*.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, although the tilt adjuster 50 is provided to the second guide shaft 39 in the above embodiment, the tilt adjuster 50 may be provided to the first guide shaft 38. The tilt adjuster 50 is provided to at least one of the pair of the first and second guide shafts 38 and 39, or it can be provided to both of the first and second guide shafts 38 and 39.

Although the tilt adjuster 50 displaces the second guide shaft 39 by using the cam 51 in the above embodiment, the tilt adjuster 50 may not be limited to the cam mechanism. For example, the tilt adjuster 50 may be configured so that the end 391*b* is displaced by using a handle or a holding mechanism by hand in a direct manner and the position is retained at the appropriate point by a fixing tool or other means. Alternatively, the second guide shaft 39 may be displaced by using other mechanism such as a feed screw.

What is claimed is:

1. A printer comprising:

a printing head;

a platen positioned opposite the printing head;

a ribbon holding shaft configured to hold an ink ribbon that is wound thereon;

a ribbon winding shaft configured to wind and collect the ink ribbon supplied from the ribbon holding shaft via an ink ribbon feeding path that passes between the printing head and the platen; and first and second guide shafts provided along the ink ribbon feeding path between the ribbon holding shaft and the ribbon winding shaft to apply tension to the ink ribbon, wherein the ribbon holding shaft, the ribbon winding shaft, and the first and second guide shafts extend along a width direction of the ink ribbon, and at least one of the first and second guide shafts has a first end portion having a supporting pin extending along a ribbon feeding direction and a second end portion opposite to the first end portion, the second end portion being rotatable around the supporting pin to apply a twist to the ink ribbon in the width direction of the ink ribbon.

2. The printer according to claim 1, wherein the ribbon holding shaft and the ribbon winding shaft each have a fixed end on the same end as the first end portion and a free end on the same end as the second end portion.

3. The printer according to claim 1, wherein the first guide shaft is on the ribbon holding shaft side of the ink ribbon feeding path and the second guide shaft is on the ribbon winding shaft side of the ink ribbon feeding path, and the second guide shaft has the first end portion and the second end portion.

4. The printer according to claim 3, wherein the second end portion of the second guide shaft is movable by a cam mechanism including a cam that is in contact with the second end portion of the second guide shaft and is rotatable to displace the position of the second end portion of the second guide shaft, to apply the twist to the ink ribbon through the second guide shaft.

5. The printer according to claim 4, wherein the cam mechanism has a ratchet mechanism, and a rotation of the cam causes the position of the second end portion of the second guide shaft to displace in a stepwise manner through the ratchet mechanism.

6. The printer according to claim 5, wherein the cam has a knob that is rotatable by an operator to control an amount of the twist applied to the ink ribbon through the second guide shaft.

7. The printer according to claim 1, further comprising:

a first spring member urging the second end portion in a first rotational direction around the pivotal shaft supporting pin.

8. The printer according to claim 7, further comprising:

a second spring member urging the second end portion in a second rotational direction around the supporting pin, the second rotational direction being opposite to the first rotational direction.

9. The printer according to claim 1, wherein the supporting pin extends in the first end portion.

10. A method of correcting a twist of an ink ribbon in a printer that is fed from a ribbon holding shaft to a ribbon winding shaft via an ink ribbon feeding path that passes between a printing head of the printer and a platen of the printer, said method comprising:

applying tension to the ink ribbon using a first guide shaft on the ribbon holding shaft side of the ink ribbon feeding path;

applying tension to the ink ribbon using a second guide shaft on the ribbon winding shaft side of the ink ribbon feeding path; and pivoting the second guide shaft about a supporting pin extending along a ribbon feeding direction at a first end portion thereof to apply a twist to the ink ribbon in a width direction of the ink ribbon.

11. The method according to claim 10, further comprising:

rotating a cam that is contact with a second end portion of the second guide shaft to pivot the second guide shaft about the supporting pin at the first end portion thereof.

12. The method according to claim 11, further comprising:

controlling a rotational position of the cam in a stepwise manner using a ratchet mechanism.

* * * * *